United States Patent [19]

O'Connor

[11] Patent Number: 4,485,978

[45] Date of Patent: Dec. 4, 1984

[54] METHOD AND APPARATUS FOR WINDING STRAND UPON SPOOLS HAVING TAPERED END FLANGES

[75] Inventor: James A. O'Connor, Fort Wayne, Ind.

[73] Assignee: Essex Group, Inc., Fort Wayne, Ind.

[21] Appl. No.: 562,554

[22] Filed: Dec. 19, 1983

[51] Int. Cl.[3] ..... B65H 54/28

[52] U.S. Cl. ..... 242/25 R; 242/16; 242/158 R; 242/158.4 R

[58] Field of Search ..... 242/25 R, 158 R, 158.2, 242/158.3, 158.4 R, 158.4 A, 16, 17, 18 R

[56] References Cited

U.S. PATENT DOCUMENTS

| | | | |
|---|---|---|---|
| 2,254,221 | 9/1941 | Hubbard | 242/25 |
| 3,038,674 | 6/1962 | Wahl | 242/25 R |
| 3,170,650 | 2/1965 | Bauer | 242/25 |
| 3,289,956 | 12/1966 | Sjogren | 242/25 R |
| 3,413,834 | 12/1968 | Kovaleski | 72/289 |
| 3,677,483 | 7/1972 | Henrich | 242/25 R |
| 3,876,167 | 4/1975 | Nittschalk et al. | 242/25 R X |
| 3,967,787 | 7/1976 | Mulleman | 242/25 R |
| 4,004,744 | 1/1977 | Hoorelbeke | 242/25 R |
| 4,083,506 | 4/1978 | Mander et al. | 242/25 R |
| 4,130,249 | 12/1978 | Steinhilber | 242/25 |

*Primary Examiner*—Stanley N. Gilreath
*Attorney, Agent, or Firm*—Robert D. Sommer

[57] ABSTRACT

A method and apparatus for winding an advancing strand onto a spool having an out-turned conical end flange at each end of a cylindrical barrel utilizing a strand traverse guide reciprocated relative to the spool at a linear speed proportional to the relative rotational velocity of the spool. The end limits of reciprocation of the strand guide are established in relation to respective reference positions corresponding to what would be apices of the respective end flanges if the latter were not truncated. During each traverse of the strand guide toward an end flange, the number of turns wound onto the spool outward of the respective reference position is regulated in accordance with the effective winding radius of the spool as determed by measuring the length of strand wound onto the spool for a specified rotational movement thereof.

18 Claims, 4 Drawing Figures

METHOD AND APPARATUS FOR WINDING STRAND UPON SPOOLS HAVING TAPERED END FLANGES

BACKGROUND OF THE INVENTION

This invention related to a method and apparatus for winding wire and other strands onto spools and more particularly relates to a method and apparatus for winding an advancing strand onto a spool having out-turned truncated conical end flanges.

In the winding of wire onto a rotating spool having tapered or out-turned truncated conical end flanges, it is well known to guide the wire onto the spool with a reciprocating wire traverse guide which moves with strokes of increasing length as wire builds up on the spool. U.S. Pat. Nos. 2,254,221, 3,170,650, 3,413,834 and 4,130,249 each disclose machines for winding wire onto spools with tapered flanges which include means for widening the limits of traversing movements in response to build up of wire on the spools. In the apparatus of U.S. Pat. No. 2,254,221, the distance of traverse movement is controlled with a switch actuating lever which upon physical engagement with the spool end flanges effects a reversal of the traverse device. The traverse reversing mechanism of U.S. Pat. No. 3,170,650 is controlled by a follower roller arranged to engage wire wound on the spool and effective to increase the distance of traverse movement in response to build up of wire on the spool. In the apparatus of U.S. Pat. No. 3,413,834, the reversal points of the traverse guide are controlled by a timer which is effective to incrementally increase the movement limits of the traverse guide after a fixed period of time corresponding to a selected number of traverse movements. A counter counting the revolutions of the spool is employed in the apparatus of U.S. Pat. No. 4,130,249 for reversing the direction of movement of the wire traverse guide when the count reaches a predetermined number which is incrementally increased a given amount each time the movement of the traverse guide undergoes a given number of reversals.

With the greatly increased use of taper flange spools in recent years, a need has arisen for a simple and versatile wire spooling machine capable of winding wire on spools of varying sizes ranging from small sizes to large sizes accommodating as much as 450 kilograms. Such a wire spooling machine should also be readily adaptable to winding wire of varying sizes and winding properties on spools differing in end flange taper angles and in flange-to-flange distances. Prior wire winding machines of the types described above are generally of a complex nature requiring substantial set-up times for adjusting and changing stops, limit switches, pinions or the like for each different size of wire or for winding wire on each different size of spool. Although the apparatus of U.S. Pat. No. 4,130,249 is of less complexity, it suffers from the disadvantage that it does not automatically compensate for variations in the size of the wire or other parameters affecting fill of the wire on the spool such as wire tension, turns per centimeter, or different wire lubricities, all of which can affect the apparent density of the wire on a spool.

A new type of wire spooling machine which overcomes many of the drawbacks of prior wire spooling machines is described in applicant's co-pending U.S. application Ser. No. 439,707, filed Nov. 8, 1982 and now abandoned. In the spooling machine described in this application, the wire traverse guide is reciprocated relative to the spool at a linear speed proportional to the speed of advancement of the wire as it is wound onto a spool. The end limits of reciprocation of the wire traverse guide are established in relation to reference positions corresponding to what would be apices of the respective spool end flanges if the latter were not truncated. These end limits are established by simply winding outward of each reference position a number of wire turns having a selected value dependent upon the angularity of the end flanges and the ratio of the wire guide speed and the wire advancement speed. In the manufacture of wire and other strand products, however, it is often advantageous to take up a wire or the like with a spooling machine having a wire guide reciprocated at a linear speed proportional to the rotational velocity of the spool rather than at a speed proportional to the speed of wire advancement so that the wire can be continuously taken up on the spool in closely spaced helical turns during each traverse movement of the wire guide.

SUMMARY OF THE INVENTION

According to this invention, there are provided an improved method and apparatus for winding an advancing strand onto a spool having an out-turned truncated conical end flange at one or both ends of a cylindrical barrel wherein a strand guide is traversed back and forth relative to the spool at a linear speed proportional to the relative rotational velocity of the spool to effect the same uniform distribution of strand turns onto the spool upon each traverse movement of the strand guide. The end limits of reciprocation of the strand guide are established in relation to a respective first reference position for each end flange corresponding to what would be the apex of that end flange if it were not truncated. The definite geometrical relationship between the length of the effective winding radius of the spool and the axial distance along the effective winding radius of the spool and the axial distance along the effective winding radius between each reference position and the respective end flange is employed to determine the required number of strand turns to be wound outward of each first reference position. During each relative longitudinal movement of the strand guide toward an end flange, a count of the number of strand turns wound onto the spool is commenced when the strand guide passes a first reference position indicative of a longitudinally aligned relation of the strand guide with what would be the apex of that end flange if it were not truncated. Also during each relative longitudinal movement of the strand guide toward an end flange, the length of strand wound onto the spool for a specified rotational movement of the spool is measured to obtain a length value which is proportional to the effective winding radius of the spool. This length value further represents a particular length of strand which is to be wound in a predetermined number onto the spool during relative longitudinal movement of the strand guide and the spool from the first reference position to a second reference position indicative of a longitudinally aligned relation of the strand guide with the end of the barrel at the respective end flange. The motion of the strand guide is reversed when the number of turns counted reaches a value substantially equal to the quotient of the particular length of strand represented by the respectively obtained length value divided by a predetermined reference value which represents the length of a single turn of strand wound onto the bare spool barrel.

For a better understanding of the invention, reference may be had to the following detailed description taken in connection with accompanying drawings, in which:

DESCRIPTION OF THE PREFERRED EMBODIMENTS

The present invention will be explained in connection with one type of strand spooling apparatus in which a spool to be wound with strand is rotated about its longitudianl axis and a strand guide is reciprocated along the longitudinal axis of the spool to distribute turns of the strand onto the spool. However, the invention may be equally well utilized with other types of spooling apparatus such as those disclosed in the Henrich U.S. Pat. Nos. 4,050,640 and 4,050,641 which employ a strand guide flyer mounted for rotary movement around a spool.

Figure 1:
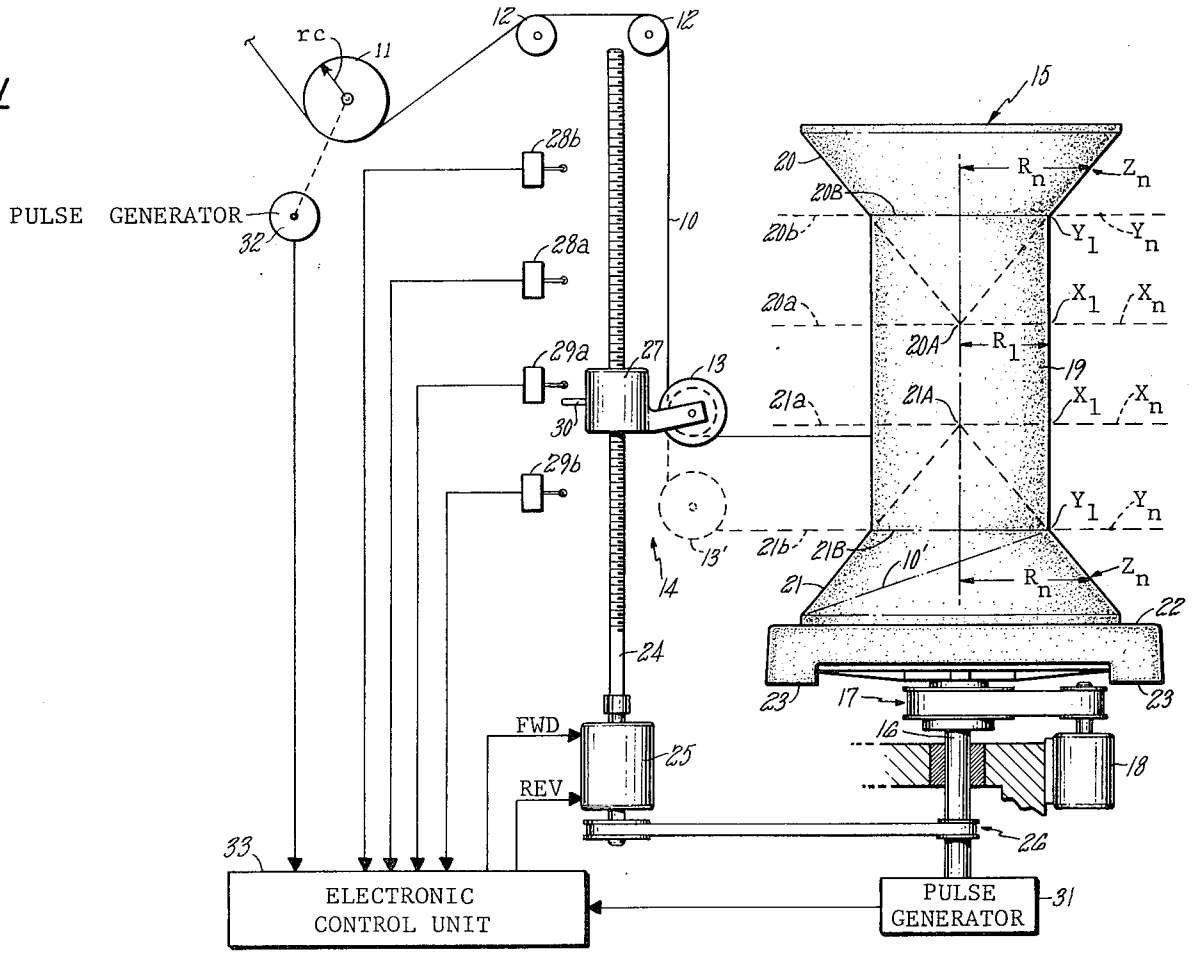
FIG. 1 is a diagrammatic representation of strand spooling apparatus constructed in accordance with the present invention.

Referring to FIG. 1 a strand or wire 10 such as an insulated copper wire withdrawn from wire processing equipment or a supply reel (not shown) is advanced into engagement with a wire feed capstan 11 which either may be driven to advance the wire 10 at a given linear speed or may be rotated by the advancing wire 10 at a speed proportional to a given linear speed of advancement thereof. The wire 10 passes around one or more guide rollers 12 to the wire guide sheave 13 of a traverse mechanism 14. The sheave 13 distributes turns of the wire 10 on a take-up spool 15 which is rotated about its central longitudinal axis by a main drive shaft 16. The drive shaft 16 is connected by means of a pulley and belt transmission 17 to an electric motor 18 or other suitable motive means.

In one form of the invention wherein the capstan 11 is rotated by the advancing wire 10 at a speed proportional to the speed of wire advancement, the motor 18 may be a conventional adjustable-speed motor which runs at a selected uniform speed to rotate the spool 15 with a substantially constant rotational velocity. In another form of the invention wherein the wire 10 is advanced by the capstan 11 at a generally uniform linear speed, the motor 18 is preferably of the constant-torque type. As is well known, a motor 18 of the latter type rotates the spool 15 with a controlled torque effective to maintain a substantially constant tension in the wire 10 being supplied to the spool 15. Because the wire 10 is being supplied at a controlled rate, the speed of the motor 18 and the rotational velocity of the spool 15 are reduced as build up of wire 10 on the spool 15 increases the winding diameter thereof. Although the invention is more particularly described hereinafter in connection with the form employing a wire advancing capstan 11 and a spool rotating motor 18 of the constant-torque type, it will become evident that the invention is equally applicable to the alternate form employing a capstan 11 rotated by the advancing wire 10 and a spool rotating motor 18 of the adjustable speed type.

The spool 15 has a generally cylindrical barrel 19 and two tapered or out-turned truncated conical end flanges 20 and 21 of any selected predetermined angularity with respect to the central axis of the spool 15. As shown in FIG. 1, spool 15 is of a construction similar to that disclosed in U.S. Pat. No. 4,253,570 and includes an integral platform 22 with supporting legs 23 to permit transport of the spool with a forklift truck. However, taper flange spools of other constructions such as those disclosed in U.S. Pat. Nos. 4,140,289 and 4,269,371 may be utilized in connection with the present invention.

The traverse mechanism 14 includes a screw shaft 24 journalled in spaced relation with the spool 15 and driven by the motor 18 at a rotational speed directly related to the rotational speed of the spool 15. The screw shaft 24 is connected to a reversing mechanism 25 which, in turn, is connected by a non-slip belt and pulley arrangement 26 to the main drive shaft 16. Depending on whether it is supplied with a forward (FWD) or a reverse (REV) electrical signal, the reversing mechanism 25 causes the screw shaft 24 to rotate in either a clockwise or a counterclockwise direction. A carriage 27 which rotatably supports the sheave 13 carries a ball nut threadably engaging the screw shaft 24 for effecting reciprocation of the sheave 13 back and forth lengthwise of the spool 15 to distribute turns of wire 10 along the length of the spool.

In operation of the spooling apparatus shown in FIG. 1, an empty spool 15 is set in place for rotation by the motor 18. With the wire guide sheave 13 in the position shown by dashed lines 13' in FIG. 1, the wire 10 to be wound onto the spool 15 is passed over the rollers 12 and around the sheave 13. The leading end 10' of the wire 10 is then secured to the spool 15 as by tying it to a knob (not shown) on the platform 22 of the spool. Upon actuation of the capstan 11 to advance the wire 10 toward the spool 15, the motor 18 is started and begins rotating the spool and the screw shaft 24. As the wire begins to be taken up on the rotating spool 15, the first turn of wire will run up the end flange 21 to the lower end 21B of the barrel 19. Thereafter, turns of wire are helically wound upon the barrel 19 as the sheave 13 is advanced upwardly by the rotating screw shaft 24. A first layer of uniformly distributed helical turns of wire will thus be wound upon the spool barrel 19. Upon actuation of the reversing mechanism 25 to cause rotation of the screw shaft 24 in an opposite direction, the sheave 13 is advanced downwardly to wind a second layer of wire over the first layer. Further upward and downward traverses of the sheave 13 results in the build up of wire on the spool with the formation of superimposed layers of turns.

In order to distribute the wire 10 from a position adjacent one end flange 20 of the spool 15 to a position adjacent the other end flange 21 as wire builds up on the spool, the limits of reciprocation of the sheave 13 are controlled in accordance with the present invention to automatically increase the extent of movement of the sheave 13 during the wire build up on the spool. To accomplish this control, means are provided to: (1) determine a first reference position of the wire guide sheave with respect to each end flange of the spool which is indicative of a longitudinally aligned relation of the sheave with what would be the apex of that end flange if it were not truncated; (2) count the number of turns wound onto the spool each time the sheave passes a first reference position in approaching an end flange of the spool; (3) measure each time the sheave approaches an end flange the length of wire wound onto the spool for a specified rotation of the spool; and (4) compare each count of the number of turns with the respective measured length of wire and reversing the direction of movement of the sheave when the count of the number of turns attains a predetermined value dependent on the measured length.

One means for determining the desired first reference positions of the wire guide sheave 13 with respect to the spool 15 include position detecting switches 28*a* and 29*a* adjustably mounted along the path of travel of the sheave 13. An actuator 30 mounted on the carriage 27 is adapted to actuate the switch 28*a* during upward movement of the sheave 13 and to actuate the switch 29*a* during downward movement of the sheave 13. The switches 28*a* and 29*a* are mounted in spaced relation corresponding to the spacing of respective imaginary planes perpendicular to the central axis of the spool 15 and shown by the dashed lines 20*a* and 21*a*. The imaginary planes 20*a* and 21*a* extend through what would be the respective apices indicated at 20A and 21A of the spool end flanges 20 and 21 if they were not truncated. When the wire 10, as guided by the sheave 13 during upward movement thereof in approaching the end flange 20, passes through the imaginary plane 20*a* in reaching the winding space of the spool 15, the switch 28*a* is operated by the actuator 30 to generate a first reference position control signal. When the wire 10, as guided by the sheave 13 during downward movement thereof in approaching the end flange 21, passes through the imaginary plane 21*a*, the switch 29*a* is operated by the actuator 30 to generate a respective first reference position control signal.

A suitable means for counting the number of turns of wire wound onto the spool 15 may include a pulse generator 31 which may be driven by the main drive shaft 16. The pulse generator 31 provides a turns signal preferably in the form of a predetermined number such as six of electrical signal pulses in response to each revolution of the spool 15. The pulse generator 31 may be, for example, a magnetic or optical transducer.

Means for measuring the length of wire being wound onto the spool 15 may include a pulse generator 32 operatively coupled to the capstan 11 and producing a number of electrical signal pulses in response to each revolution of the capstan 11. The capstan 11 which is also a measuring roll has a circumference of predetermined length in engagement with the wire 10 as it is supplied to the spool 15. Thus, the pulse generator 32 provides a length signal in the form of a series of electrical signal pulses in amounts related to the numbers of incremental lengths of wire 10 being wound onto the spool 15.

The specified rotation of the spool 15 during which the length of wire 10 wound onto the spool is measured may be determined in various ways such as by counting a selected number of spool revolutions. It is convenient, however, to employ for this purpose the position detecting switches 28*a* and 29*a* with two additional position detecting switches 28*b* and 29*b* which are also adjustably mounted along the path of travel of the sheave 13 for actuation by the actuator 30. The switches 28*b* and 29*b* are mounted in spaced relation corresponding to the spacing of respective imaginary planes shown by the dashed lines 20*b* and 21*b*. These planes 20*b* and 21*b* are perpendicular to the central axis of the spool 15 and extend through the respective ends 20B and 21B of the spool barrel. The switch 28*b* is operated by the actuator 30 to generate a second reference position control signal when the wire 10, as guided by the sheave 13 during upward movement thereof in approaching the end flange 20, passes through the imaginary plane 20*b* in reaching the winding space of the spool. Similarly, the switch 29*b* is operated by the actuator 30 to also generate a second reference position control signal when the wire 10, as guided by the sheave 13 during downward movement thereof, passes through the imaginary plane 21*b* in reaching the winding space of the spool. Since the spool 15 inherently rotates a predetermined constant number of revolutions each time the sheave 13 moves from a first reference position to a respective second reference position at each end of the spool, the time interval between the generation of a first control signal by one of the switches 28*a* and 29*a* and the generation of a consequent second control signal by a respective one of the switches 28*b* and 29*b* is a direct function of a specified rotation of the spool 15.

The outputs of the position detecting switches 28*a*, 28*b*, 29*a*, 29*b*, and the pulse generators 31 and 32 are operatively coupled to an electronic control unit 33 which includes means for comparing a count of the number of turns of wire wound onto the spool with a respective measured length of wire wound onto the spool and issuing a direction reversing signal to the reversing mechanism 25 when the count attains a predetermined value dependent on the measured length. The particular manner in which the end limits of the travel of the wire guide sheave 13 are so determined from the relation between selected turns count and measured length values will be explained before proceeding with a detailed description of the electronic control unit 33.

As the wire 10 is wound onto the spool 15, the effective winding radius of the spool is initially the radius $R_1$ of the bare spool barrel 19 and increases to the value $R_n$ with the formation of superimposed layers of wire turns. At the initial effective winding radius $R_1$, the direction of travel of the wire guide sheave 13 is reversed when the wire 10 guided by it approaches the point $Y_1$ at each of the barrel ends 20B and 21B. At any increased effective winding radius $R_n$, the direction of travel of the sheave 13 must be reversed when the wire guided by it approaches the point $Z_n$ at each of the end flanges 20 and 21. During each traverse of the wire 10 to a point $Z_n$ at one of the end flanges 20 and 21, it passes through a point $X_n$ on the respective imaginary plane 20*a* or 21*a* at that end of the spool and then passes through a point $Y_n$ on the associated imaginary plane 20*b* or 21*b*.

Figure 2:
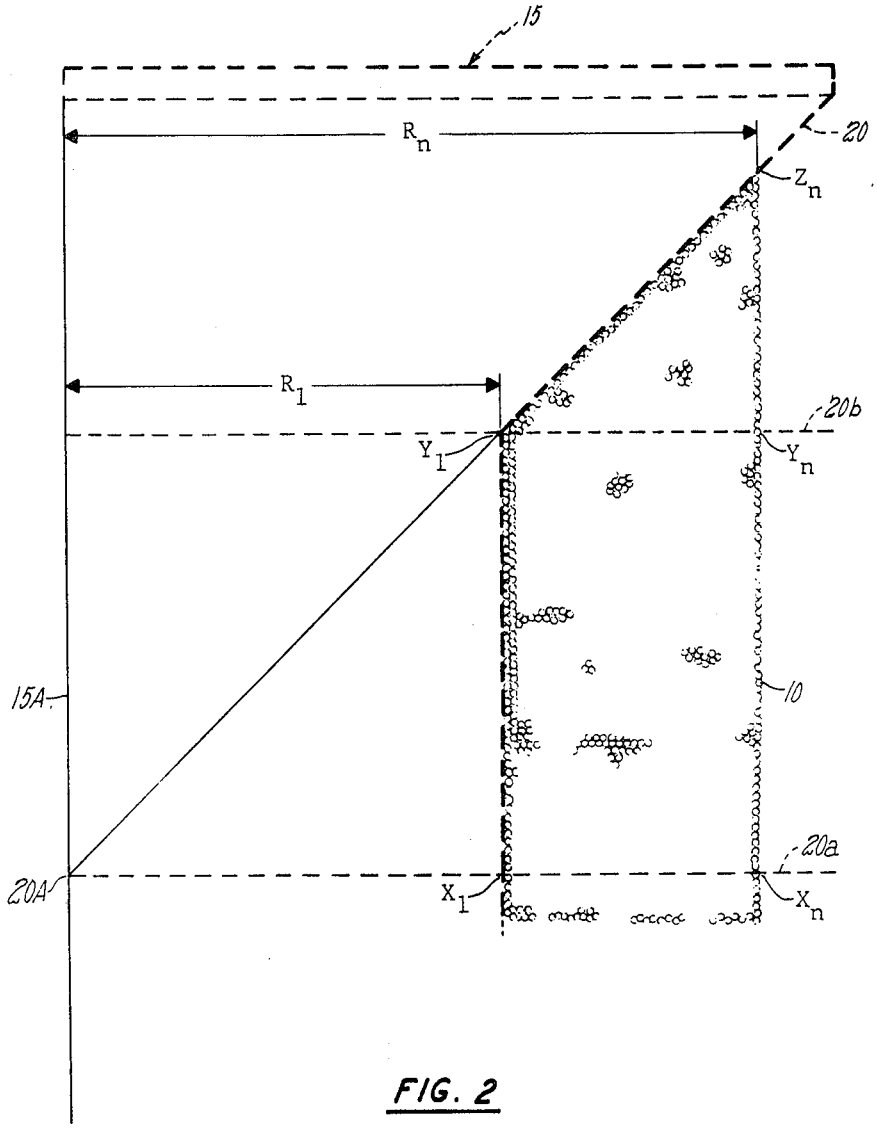
FIG. 2 is an explanatory diagram illustrating geometric aspects of the principles upon which the present invention is based.

It is to be noted that at each end of the spool 15 the distance between the points $X_n$ and $Y_n$ is the same proportion of the distance between the points $X_n$ and $Z_n$ for any effective winding radius $R_n$ as the ratio of the initial winding radius $R_1$ to that winding radius $R_n$. This will be evident from a consideration of FIG. 2 where a portion of the upper end of the spool 15 indicated by dashed lines is shown with turns of wire 10 accumulated thereon from the initial winding radius $R_1$ to an effective winding radius $R_n$. A portion of the central longitudinal axis of the spool 15 is shown by line 15A and an extension of the end flange 20 to the axis 15A is indicated by a line extending from the point $Y_1$ to the apex 20A. The triangle with vertices at 20A, $X_1$ and $Y_1$ and the triangle with vertices at 20A, $X_n$ and $Z_n$ are similar triangles with corresponding sides which are proportional. It will be evident that for any effective winding radius $R_n$ the ratio of the distance between points $X_n$ and $Z_n$ to the distance between points $X_n$ and $Y_n$ is equal to the ratio of that effective winding radius $R_n$ to the initial winding radius $R_1$.

Since the sheave 13 is advanced relative to the spool 15 at a linear speed proportional to the rotational speed of the spool, there is substantially equal spacing between the turns of wire 10 wound onto the spool at all effective winding radiuses. Further noting the above described relation of the distance between points $X_n$ and $Z_n$ to the distance between the points $X_n$ and $Y_n$, it will be seen that for any effective winding radius $R_n$ the ratio of the number of wire turns $N_n$ wound onto the spool 15 between each point $X_n$ and the associated point $Z_n$ to the number of wire turns $T_n$ wound between the corresponding points $X_n$ and $Y_n$ is equal to the ratio of that winding radius $R_n$ to the initial winding radius $R_1$. Thus the desired number of wire turns wound between the points $X_n$ and $Z_n$ at each end of the spool may be expressed by the equation: $N_n=T_nR_n/R_1$. Since a constant number of wire turns $T_n$ is wound between the points $X_n$ and $Y_n$ for any effective winding radius $R_n$, the length $L_n$ of wire wound onto the spool between the points $X_n$ and $Y_n$ at each end of the spool is given by the equation: $L_n=2\pi R_nT_n$. Combining the above two equations to eliminate the terms $T_n$ and $R_n$, the expression for the desired number of wire turns $N_n$ wound between the points $X_n$ and $Z_n$ may be stated as follows: $N_n=L_n/2\pi R_1$. The divisor $2\pi R_1$ in this equation is a predetermined reference value or constant which represents the length of a single turn of wire 10 wound onto the initial effective winding radius $R_1$ of the bare spool barrel 19. Thus the desired number of wire turns $N_n$ to be wound between the points $X_n$ and $Z_n$ at each end of the spool 15 will have a value which is equal to the quotient of the wire length $L_n$ wound onto the spool between the respective points $X_n$ and $Y_n$ divided by a predetermined reference value which represents the length of a single turn of wire 10 wound onto the spool barrel 19 during the initial winding of wire onto the spool.

From the foregoing relation between the desired number of wire turns $N_n$ and the wire length $L_n$, there can be derived an equivalent expression for the desired number of wire turns $N_n$ in relation to the revolutions of the capstan 13. It will be apparent that the wire length $L_n$ wound onto the spool 15 between points $X_n$ and $Y_n$ is represented by the number $C_n$ of revolutions of the capstan 13 which occur during the winding of the wire length $L_n$ onto the spool 15. As a definite length of wire 10 dependent upon the radius $r_c$ of the capstan 11 is wound onto the spool 15 during each full revolution of the capstan, there exists a relationship: $L_n=2\pi r_cC_n$. By substituting this relationship in the previously given equation for the desired number of wire turns $N_n$, there is obtained the relationship: $N_n=C_nr_c/R_1$. Noting that the ratio of any particular initial winding radius $R_1$ to a particular capstan radius $r_c$ has a definite value K, the last relationship may be expressed by the equation: $N_n=C_n/K$. Thus the desired number of wire turns $N_n$ to be wound between the points $X_n$ and $Z_n$ at each end of the spool will have a value which is equal to the quotient of the number $C_n$ of capstan revolutions occurring during winding of the wire onto the spool between the respective points $X_n$ and $Y_n$ divided by a definite value K which represents the ratio of the initial winding radius $R_1$ to the radius $r_c$ of the capstan 11.

The length of wire $L_n$ wound onto the spool 15 between the points $X_n$ and $Y_n$ does not necessarily have to be ascertained by a measurement of the wire length actually wound between these points. Because the wire length $L_n$ is wound onto the spool between the points $X_n$ and $Y_n$ with a constant number of spool revolutions, a measurement of the wire length wound onto the spool for any appropriate specified rotational movement of the spool will provide a length value from which the wire length $L_n$ can be determined. If a length value is obtained, for example, by measuring the length of wire wound onto the spool during one-third of the spool revolutions necessary to wind the number $T_n$ of wire turns, the wire length $L_n$ represented by the length value is three times the measured length value.

Figure 3:
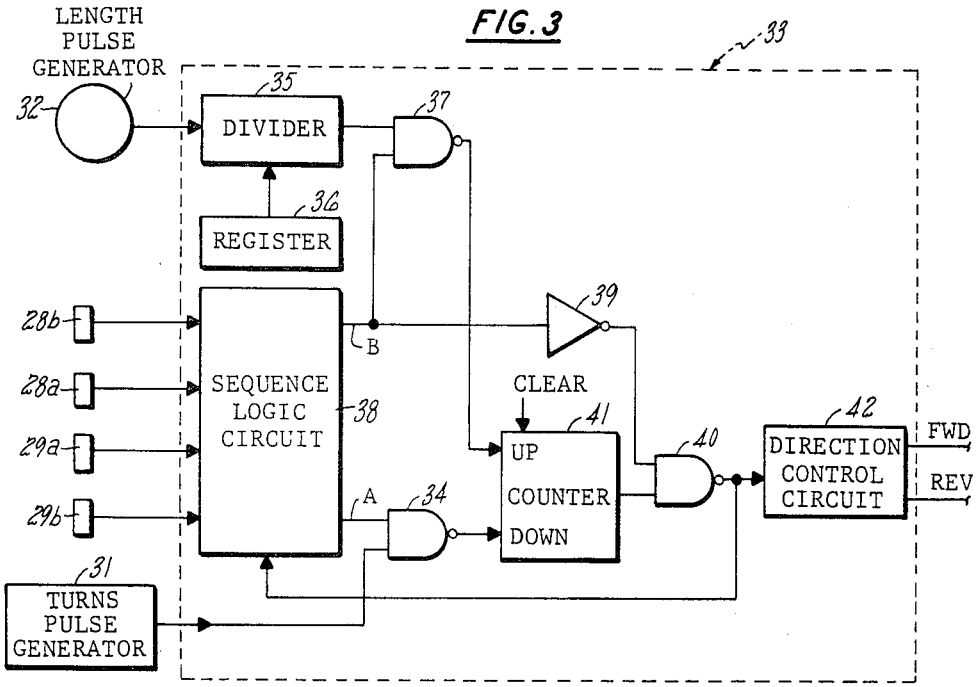
FIG. 3 is a block diagram schematically illustrating one form of an electronic control unit for the spooling apparatus of FIG. 1.

Referring now to FIG. 3, there is shown in block diagrammatic form the electronic control unit 33 for processing the outputs of the position detecting switches **28*a*, 28*b*, 29*a*, 29*b* and the pulse generators 31 and 32. The output of the turns signal pulse generator 31 is connected to one input of a gate 34. The output of the length signal pulse generator 32 is connected to the divisor input of a divider 35 which has a dividend input connected to a register 36 and an output connected to one input of a gate 37. The series of pulses generated by the pulse generator 32 is divided as it passes through the divider 35 to form another series of pulses referred to as second signal pulses. The division ratio of the divider 35 is set to produce a predetermined number of second pulses for each incremental measured length of wire 10 which is substantially equal to the aforementioned reference value representing the length of a single turn of wire initially wound onto the bare spool barrel 19. This selected predetermined number is the same as the predetermined number of first signal pulses generated by the turns signal generator 31 in response to each revolution of the spool 15**.

The reference position control signals generated by the switches **28*a*, 28*b*, 29*a*, 29*b* are applied to a sequence logic circuit 38 having outputs providing two enabling signals illustrated respectively at "A" and "B" in FIG. 3. The "A" enabling signal is supplied to the second input of the gate 34 during each time interval beginning when a first reference position control signal is generated by actuation of a switch 28*a* or 29*a* as the sheave 13 approaches a respective end of the spool 15 and continuing until the direction of movement of the sheave 13 is reversed. The "B" enabling signal is supplied to the second input of gate 37 and to the input of an inverter 39 whose output is coupled to one input of gate 40. The "B" enabling signal commences when a first reference position control signal is generated by actuation of a switch 28*a* or 29*a* as the sheave 13 approaches a respective end of the spool 15 and ends when a consequent second reference position control signal is generated by actuation of the respective switch 28*b* or 29*b***.

The output from the gate 37 is connected to the up-counting terminal of an up-down counter 41 and the output from the gate 34 is connected to the down-counting terminal of counter 41. The up-down counter 41 provides an output pulse to the second input of gate 40 whenever the counter 41 is decremented through zero. The output from gate 40 is supplied as a direction reversing signal to the input of a direction control circuit 42 which has as its output alternately one or the other of the forward (FWD) or reverse (REV) electrical signals that are supplied to the reversing mechanism 25. The direction control circuit 42 operates in response to each such input reversing signal to switch its output from the previously exisiting FWD or REV signal to the other signal. The output from the gate 40 is also connected to another input of the sequence logic circuit 38 for resetting the latter to respond to the next reference position control signal provided by one of the position detecting switches 28*a* and 29*a*.

Considering now the cycle of operation of the electronic control unit 33 each time the sheave 13 in its upward movement approaches the upper end flange 20, the cycle begins with the generation of a first reference position control signal upon actuation of the position detecting switch 28*a* as the sheave 13 passes through a first reference position corresponding to the imaginary plane 20*a*. Upon receiving this first reference position control signal, the sequence logic circuit 38 supplies the "A" and "B" enabling signals respectively to the gates 34 and 37. The gating of gate 37 permits a train of second signal pulses to pass therethrough and increment the up-down counter 41. The gating of gate 34 at the same time permits a train of first signal pulses to pass therethrough and decrement the counter 41. When the second reference position control signal is generated upon actuation of the position detecting switch 28*b* as the sheave 13 passes through a second reference position corresponding to the imaginary plane 20*b*, the "B" enabling signal is terminated by the logic circuit 38 stopping the passage of the second signal pulses to the counter 41 and causing the output of the inverter 39 supplied to the gate 40 to shift from a low state to a high state. The gate 34 continues to pass the first signal pulses until the "A" enabling signal is terminated by the logic circuit 38 in response to the gating of gate 40 when the counter 41 decrements to zero. The output of the direction control circuit 42 is also switched in response to the gating of gate 40 to cause the reversing mechanism 25 to reverse the motion of the sheave 13.

During the above described cycle of operation, the up-down counter 41 functions to compare a length value represented by the number of second signal pulses passed by the gating of gate 37 between the generation of the first and second reference position control signals with a turns count represented by the number of first signal pulses passed by the gating of gate 34 following the generation of the first reference position control signal. When the turn counts attains a value equal to the length value, a direction reversing signal is supplied to reverse the motion of the sheave 13. As explained above, the turns count bears a predetermined relation to the length value so that the extent of travel of the sheave 13 adjacent the end flange 20 is automatically increased the required amount with build up of wire 10 on the spool 15 to accommodate the extra length of winding space resulting from the tapered shape of the end flange 30. It will be apparent that the extent of travel of the sheave 13 adjacent the end flange 21 is also automatically increased in similar manner.

Figure 4:
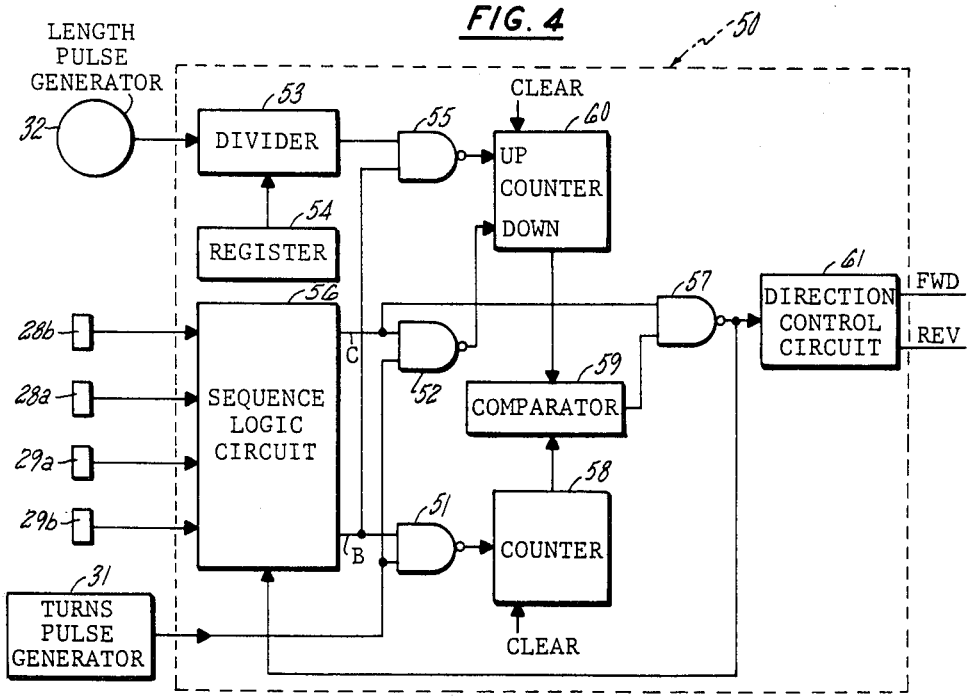
FIG. 4 is a block diagram schematically illustrating an alternative form of an electronic control unit for the spooling apparatus of FIG. 1.

FIG. 4 illustrates by means of a block diagram an alternative form of electronic control unit 50 which differs from the control unit 33 of FIG. 3 in the means for comparing the turns count with a concurrently obtained length value. The output of the turns signal pulse generator 31 is connected to one input of a gate 51 and to one input of another gate 52. The output of the length signal generator 32 is connected to the divisor input of a divider 53 which has a dividend input connected to a register 54 and an output connected to one input of a third gate 55. The series of pulses generated by the pulse generator 32 is divided as it passes through the divider 53 to form another series of pulses referred to as second signal pulses. The division ratio of the divider 53 is set to produce a predetermined number of second signal pulses for each incremental measured length of wire 10 which is substantially equal to the aforementioned reference value representing the length of a single turn of wire initially wound onto the bare spool barrel 19. This selected predetermined number is the same as the predetermined number of first signal pulses generated by the turns signal generator 31 in response to each revolution of the spool 15.

The reference position control signals generated by the switches 28*a*, 28*b*, 29*a*, 29*b* are applied to a sequence logic circuit 56 having outputs providing two enabling signals illustrated respectively at "B" and "C" in FIG. 4. The "B" enabling signal is supplied to the second input of gate 51 and to the second input of gate 55. The "B" enabling signal commences when a first reference position control signal is generated by actuation of a switch 28*a* or 29*a* as the sheave 13 approaches a respective end of the spool 15 and ends when a consequent second reference position control signal is generated by actuation of the respective switch 28*b* or 29*b*. The "C" enabling signal is supplied to the second input of the gate 52 and to one input of a fourth gate 57 during each time interval beginning when a second reference position control signal is generated by actuation of a switch 28*b* or 29*b* as the sheave 13 approaches a respective end of the spool 15 and continuing until the direction of movement of the sheave 13 is reversed.

The output from the gate 51 is connected to the input of an up counter 58. The number of first signal pulses counted by the counter 58 is represented in its output which is connected to one input of a comparator 59. The output from the gate 52 is connected to the down-counting terminal of an up-down counter 60 and the output from the gate 55 is connected to the up-counting terminal of the counter 60. A count content output of the counter 60 representing the difference between the number of up and down count inputs thereof is connected to the second input of the comparator 59. The output of the comparator 59 is connected to the second input of gate 57 and goes from a low state to a high state when the count content of the counter 60 coincides with the count in counter 58. The output from gate 57 is supplied as a direction reversing signal to the input of a direction control circuit 61 which has as its output alternately on or the other of the forward (FWD) or reverse (REV) electrical signals that are supplied to the reversing mechanism 25. The direction control circuit 61 operates in response to each such input reversing signal to switch its output from the previously exising FWD or REV signal to the other signal. The output from gate 57 is also connected to another input of the sequence logic circuit 56 for resetting the latter to respond to the next reference position control signal provided by one of the position detecting switches 28*a* or 29*a*. At this time, the counters 58 and 60 are reset to zero by a suitably supplied clear command.

Considering now the cycle of operation of the electronic control unit 50 each time the sheave 13 in its upward movement approaches the upper end flange 20, the cycle begins with the generation of a first reference position control signal upon actuation of the position detecting switch 28a as the sheave 13 passes through a first reference position corresponding to the imaginary plane 20a. Upon receiving the first reference position control signal, the sequence logic circuit 56 supplies the "B" enabling signal to each of the gates 51 and 55. The gating of gate 51 permits a train of first signal pulses to pass therethrough and increment the up counter 58. The gating of gate 55 at the same time permits a train of second signal pulses to pass therethrough and increment the up-down counter 60. When the second reference position control signal is generated upon actuation of the position detecting switch 28b as the sheave 13 passes through a second reference position corresponding to the imaginary plane 20b, the "B" enabling signal is terminated by the logic circuit 56 stopping the passage of the first signal pulses to the counter 58 and stopping the passage of the second signal pulses to the counter 60.

At the same time that the "B" enabling signal is terminated, the "C" enabling signal is supplied by the sequence logic circuit 56 to each of the gates 52 and 57. The gating of gate 52 permits a train of first signal pulses to pass therethrough and decrement the up-down counter 60. The comparator 59, to which the count previously accumulated in counter 58 is applied, compares that count with the count content output of the counter 60. When the count content of the counter 60 coincides with the count in the counter 58, the output of the comparator 59 supplied to the gate 57 shifts from a low state to a high state, causing gating of the gate 57. The "C" enabling signal is terminated by the logic circuit 56 in response to the gating of 57. The output of the direction control circuit 61 is also switched in response to the gating of gate 57 to cause the reversing mechanism 25 to reverse the motion of the sheave 13.

During the above described cycle of operation, the count accumulated in the up counter 58 is a measure of the constant number of wire turns $T_n$ wound between the points $X_n$ and $Y_n$ at the upper end of the spool 15. The count content of the up-down counter 60 is a measure of the difference between a length value representing the number of incremental lengths of wire 10 wound between the points $X_n$ and $Y_n$ and the number of wire turns wound onto the spool beyond the point $Y_n$. When the wire 10 reaches the point $Z_n$ on the end flange 20, the latter number of wires turns has a value equal to the difference between the required turns count value $N_n$ and the constant number of wire turns $T_n$. As previously explained, the turns count $N_n$ has a value equal to the length value at this time and, accordingly, the count content of the up-down counter 60 decrements at this time to the constant number of wire turns $T_n$. Thus, the count content of the up-down counter 60 coincides with the count in the up counter 58 when the turns count attains a value equal to the length value to cause the supply of a direction reversing signal for reversing the motion of the sheave 13.

The electronic control unit 50 functions in a similar manner to issue a direction reversing signal for reversing the motion of the sheave 13 as it approaches the other end flange 21. This process continues sequentially as the sheave 13 traverses back and forth between the opposite ends of the spool 15.

From the foregoing description, it is seen that the present invention affords a simple and reliable spooling method and apparatus for winding wire or other strands onto taper flange spools. Adjustment of the spooling apparatus to accommodate different sizes of taper flange spools is easily and quickly effected by relocating the position detecting switches 28a, 28b, 29a, 29b and resetting the divider register 36 or 54 of the respective electronic control unit.

While there has been described above the principles of this invention in connection with specific apparatus, it is to be understood that this description is made only by way of example and not as a limitation of the scope of the invention.

What is claimed is:

1. In the winding of an advancing strand upon a spool having an out-turned truncated conical end flange at one end of a cylindrical barrel wherein the strand is guided in its approach to the spool by a strand guide, the spool and the strand guide are rotated relative to each other about the longitudinal axis of the spool to wind turns of the strand onto the spool, and the spool and the strand guide are traversed back and forth relative to each other along a course parallel to the longitudinal axis of the spool at a relative linear speed which is related to the speed of relative rotational movement between the spool and the strand guide by a predetermined speed ratio to effect the uniform distribution of turns of strand along the spool and the formation of superimposed layers of said turns following the initial winding of strand onto the spool; the method of increasing the extent of relative longitudinal movement between the spool and the strand guide during strand build-up on the spool which comprises the steps of:

during each relative longitudinal movement of the strand guide toward said end flange commencing a count of the number of turns of strand wound onto the spool at the time when the strand guide passes a first reference position indicative of a longitudinally aligned relation of the strand guide with what would be the apex of said end flange if the same were not truncated;

during each relative longitudinal movement of the strand guide toward said end flange measuring the length of strand wound onto the spool for a specified rotational movement of the spool relative to the strand guide to obtain a length value representing the length of strand which is wound in a predetermined number of turns onto the spool during relative longitudinal movement of the strand guide and the spool from said first reference position to a second reference position indicative of a longitudinally aligned relation of the strand guide with said one end of the barrel; and comparing each count of the number of turns with the respectively obtained length value and reversing the direction of relative longitudinal movement between the strand guide and the spool when the number of turns counted has reached a predetermined value which is substantially equal to the quotient of the length of strand represented by said respective length value divided by a predetermined reference value which represents the length of a single turn of strand wound onto the spool barrel during the initial winding of strand onto the spool.

2. A method according to claim 1 wherein:

the step of counting the number of turns of strand comprises generating a first control signal upon relative longitudinal movement of the strand guide into longitudinal aligned relation with what would be the apex of said end flange if the same were not truncated, generating a first predetermined number of first signal pulses in response to each revolution of relative rotation between the spool and the strand guide, and commencing a count of said first signal pulses at the time when said first control signal is generated to obtain a first pulse number;

the step of measuring the length of strand comprises generating a second control signal upon longitudinal movement of the strand guide into longitudinally aligned relation with said one end of the barrel, generating a second predetermined number of said second signal pulses equal to said first predetermined number in response to the the winding onto the spool of each incremental length of strand which is substantially equal to said predetermined reference value, and counting said second signal pulses from the time at which said first control signal is generated to the time at which said second control signal is generated to obtain a second pulse number; and the step of comparing each count of the number of turns with a respective length value and reversing the direction of relative longitudinal movement comprises continuously comparing said first pulse number with said second pulse number to provide an output signal for reversing the direction of relative longitudinal movement between the strand guide and the spool when said first pulse number corresponds to said second pulse number.

3. A method according to claim 1 wherein:

the step of measuring the length of strand is commenced each time the strand guide passes said first reference position and is concluded upon consequent movement of the strand guide to said second reference position.

4. A method according to claim 3 wherein:

the step of counting the number of turns comprises counting the number of turns of strand wound onto the spool during relative longitudinal movement of the strand guide and the spool between said first and second reference positions to obtain a first count number, and commencing a further count of the number of turns of strand wound onto the spool at the time when the strand guide passes said second reference position to obtain a second count number;

the step of measuring the length of strand comprises ascertaining the number of incremental lengths of strand equal to said predetermined reference value which are wound onto the spool during the time of relative longitudinal movement of the strand guide and the spool from said first reference position to said second reference position; and the step of comparing each count of the number of turns with the respective length value and reversing the direction of relative longitudinal movement comprises continuously subtracting said second count number from said number of incremental lengths of strand to obtain a difference number representative of the difference thereof, continuously comparing said difference number with said first count number, and reversing the direction of relative longitudinal movement between the strand guide and the spool when said difference number corresponds to said first count number.

5. A method according to claim 1 wherein:

the step of counting the number of turns of strand comprises generating a first control signal upon relative longitudinal movement of the strand guide into longitudinal aligned relation with what would be the apex of said end flange if the same were not truncated, generating a second control signal upon relative longitudinal movement of the strand guide into longitudinally aligned relation with said one end of the barrel, generating a first predetermined number of first signal pulses in response to each revolution of relative rotation between the strand guide and the spool, counting said first signal pulses from the time at which said first control signal is generated to the time at which said second control signal is generated to obtain a first pulse number, and commencing a further count of said first signal pulses at the time when said second control signal is generated to obtain a second pulse number;

the step of measuring the length of strand comprises generating a second predetermined number of said second signal pulses equal to said first predetermined number in response to the winding onto the spool of each incremental length of strand which is substantially equal to said predetermined reference value, and counting said second signal pulses from the time at which said first control signal is generated to the time at which said second control signal is generated to obtain a third pulse number; and the step of comparing each count of the number of turns with a respective length value and reversing the direction of relative longitudinal movement comprises continuously subtracting said second pulse number from said third pulse number to provide a difference pulse number representative of the difference thereof; continuously comparing said difference pulse number with said first pulse number to provide an output signal for reversing the direction of relative longitudinal movement between the strand guide and the spool when said difference pulse number corresponds to said first pulse number.

6. In the winding of an advancing strand upon a spool having an out-turned truncated conical end flange at each end of a cylindrical barrel wherein the strand is guided in its approach to the spool by a strand guide, the spool and the strand guide are rotated relative to each other about the longitudinal axis of the spool to wind turns of the strand onto the spool, and the spool and the strand guide are traversed back and forth relative to each other along a course parallel to the longitudinal axis of the spool at a relative linear speed which is related to the speed of relative rotational movement between the spool and the strand guide by a predetermined speed ratio to effect the uniform distribution of turns of strand along the spool and the formation of superimposed layers of said turns following the initial winding of strand onto the spool; the method of increasing the extent of relative longitudinal movement between the spool and the strand guide during strand build-up on the spool which comprises the steps of:

during every relative longitudinal movement of the strand guide toward each end flange of the spool commencing a count of the number of turns of strand wound onto the spool at the time when the strand guide passes a respective first reference position indicative of a logitudinally aligned relation of the strand guide with what would be the apex of said each end flange if the same were not truncated;

during each relative longitudinal movement of the strand guide toward each end flange of the spool measuring the length of strand wound onto the spool for a specified rotational movement of the spool relative to the strand guide to obtain a length value representing the length of strand which is wound in a predetermined number of turns onto the spool during relative longitudinal movement of the strand guide from said respective first reference position to an associated second reference position indicative of a longitudinally aligned relation of the strand guide with the respective end of the barrel at said each end flange; and comparing each count of the number of turns with the respectively obtained length value and reversing the direction of relative longitudinal movement between the strand guide and the spool when the number of turns counted has reached a predetermined value which is substantially equal to the quotient of the length of strand represented by said respective length value divided by a predetermined reference value which represents the length of a single turn of strand wound onto the spool barrel during the initial winding of strand onto the spool.

7. A method according to claim 6 wherein:

the step of counting the number of turns of strand comprises generating a first control signal upon relative longitudinal movement of the strand guide into longitudinally aligned relation with what would be the apex of said each end flange if the same were not truncated, generating a first predetermined number of first signal pulses in response to each revolution of relative rotation between the spool and the strand guide, and commencing a count of said first signal pulses at the time when the respective first respective control signal is generated to obtain a first pulse number;

the step of measuring the length of strand comprises generating a second control signal upon relative longitudinal movement of the strand guide into longitudinally aligned relation with the respective end of the barrel at said each end flange, generating a second predetermined number of second signal pulses equal to said first predetermined number in response to the winding onto the spool of each incremental length of strand which is substantially equal to said predetermined reference value, and counting said second signal pulses from the time at which the respective first control signal is generated to the time at which the respective second control signal is generated to obtain a second pulse number; and the step of comparing each count of the number of turns with a respective length value and reversing the direction of relative longitudinal movement comprises continuously comparing each first pulse number with the respective second pulse number to provide an output signal for reversing the direction of relative longitudinal movement between the strand guide and the spool when said first pulse number corresponds to said second pulse number.

8. A method according to claim 6 wherein:

the step of measuring the length of strand is commenced each time the strand guide passes said respective first reference position and is concluded upon consequent movement of the strand guide to said respective associated second reference position.

9. A method according to claim 8 wherein:

the step of counting the number of turns comprises counting the number of turns of strand wound onto the spool during relative longitudinal movement of the strand guide and the spool between the respective first and second reference positions to obtain a first count number, and commencing a further count of the number of turns of strand wound onto the spool at the time when the strand guide passes the respective second reference position to obtain a second count number;

the step of measuring the length of strand comprises ascertaining the number of incremental lengths of strand equal to said predetermined reference value which are wound onto the spool during the time of relative longitudinal movement of the strand guide and the spool from the respective first reference position to the respective second reference position; and the step of comparing each count of the number of turns with the respective length value and reversing the direction of relative longitudinal movement comprises continuously subtracting the respective second count number from the respective number of incremental lengths of strand to obtain a difference number representative of the difference thereof, continuously comparing said difference number with the respective first count number, and reversing the direction of relative longitudinal movement between the strand guide and the spool when said difference number corresponds to the respective first count number.

10. A method according to claim 6 wherein:

the step of counting the number of turns of strand comprises generating a first control signal upon relative longitudinal movement of the strand guide into longitudinally aligned relation with what would be the apex of said each end flange if the same were not truncated, generating a second control signal upon relative longitudinal movement of the strand guide into longitudinally aligned relation with the respective end of the barrel at said each end flange, generating a first predetermined number of first signal pulses in response to each revolution of relative rotation between the spool and the strand guide, counting said first signal pulses from the time at which the respective first control signal is generated to the time at which the respective second control signal is generated to obtain a first pulse number, and commencing a further count of said first signal pulses from the time at when the respective second control signal is generated to obtain a second pulse number;

the step of measuring the length of strand comprises generating a second predetermined number of said second signal pulses equal to said first predetermined number in response to the winding onto the spool of each incremental length of strand which is substantially equal to said predetermined reference value, and counting said second signal pulses from the time at which the respective first control signal is generated to the time at which the respective second control signal is generated to obtain a third pulse number; and the step of comparing each count of the number of turns with a respective length value and reversing the direction of relative longitudinal movement comprises continuously subtracting the respective second pulse number from the respective third pulse number to provide a difference pulse number representative of the difference thereof; continuously comparing said difference pulse number with the respective first pulse number to provide an output signal for reversing the direction of relative longitudinal movement between the strand guide and the spool when said difference pulse number corresponds to the respective first pulse number.

11. In a spooling machine for winding an advancing strand upon a spool having an out-turned truncated conical end flange at one end of a cylindrical barrel, said spooling machine including:

a strand guide for guiding the strand in its approach to the spool;

motive means for effecting relative rotation between the spool and the strand guide about the longitudinal axis of the spool to wind turns of the strand onto the spool;

and drive means including reversing means for effecting relative longitudinal reciprocatory movement between the spool and the strand guide along a course parallel to the longitudinal axis of the spool at a relative linear speed which is related to the speed of relative rotational movement between the spool and the strand guide by a predetermined speed ratio to effect the uniform distribution of turns of strand along the spool and the formation of superimposed layers of said turns following the initial winding of strand onto the spool;

the improvement comprising:

rotation sensing means responsive to the relative rotation of the spool with respect to the strand guide during each relative longitudinal movement of the strand guide toward said end flange and providing a count representative of the number of turns of strand wound onto the spool commencing at the time when the strand guide passes a first reference position indicative of a longitudinally aligned relationed of the strand guide with what would be the apex of said end flange if the same were not truncated;

length measuring means sensing the length of strand wound onto the spool for a specified rotational movement of the spool relative to the strand guide during each relative longitudinal movement of the strand guide toward said end flange and providing a length value representing the length of strand wound in a predetermined number of turns onto the spool barrel during relative longitudinal movement of the strand guide and the spool from said first reference position to a second reference position indicative of a longitudinally aligned relation of the strand guide with said one end of the barrel; and means for supplying a direction reversing signal to said reversing means to reverse the direction of relative longitudinal movement between the strand guide and the spool, said reversing signal supply means including comparison means connected to said rotation sensing means and said length measuring means for comparing each said count of the number of turns with a respectively provided length value and issuing said direction reversing signal when the number of turns of strand wound onto the spool attains a value which is substantially equal to the quotient of the length of strand represented by the respective length value divided by a predetermined reference value which represents the length of a single turn of strand wound onto the spool barrel during the initial winding of strand onto the spool.

12. The improvement of claim 11 including:

position detecting means responsive to the relative position of the strand guide with respect to the spool in relative approach of the strand guide to said end flange for generating a first reference position control signal upon relative movement of the strand guide to said first reference position, and for generating a second reference position control signal upon relative movement of the strand guide to said second reference position;

said rotation sensing means receiving said first control signal as an input and providing said count by producing as an output a turns signal representative of the number of turns of strand wound onto the spool following the generation of said first control signal;

said length measuring means receiving said first and second control signals as inputs and providing said length value by producing as an output a length signal representative of the length of strand wound onto the spool during the time interval between the generation of a first control signal and a consequent second control signal; and said comparison means receiving said turns signal and said length signal as inputs and comparing each said turns signal with a respective concurrently produced length signal.

13. The improvement of claim 12 wherein:

said rotation sensing means include:

first pulse generator means for generating a first predetermined number of first signal pulses in response to each revolution of relative rotation between the spool and the strand guide, and first gate means operatively coupling said first pulse generator means to said comparison means for passing said first signal pulses to said comparison means following the generation of said first control signal;

said length measuring means include:

second pulse generator means for generating a second predetermined number of second signal pulses equal to said first predetermined number in response to the winding onto the spool of each incremental length of strand which is substantially equal to said predetermined value, and second gate means operatively coupling said second pulse generator means to said comparison means for passing said second signal pulses to said comparison means during the time interval between the generation of said first and second control signals; and said comparison means include:

up-down counter means having input terminal means operatively connected to receive said first signal pulses when passed by said first gate means for counting in one direction and to receive said second signal pulses when passed by said second gate means for counting in the opposite direction, and circuit means operatively coupled to said up-down counter means for issuing said direction reversing signal when said up-down counter means has counted backward in said one direction to zero.

14. The improvement of claim 12 wherein:

said rotation sensing means include:

first pulse generator means for generating a first predetermined number of first signal pulses in response to each revolution of relative rotation between the spool and strand guide, first gate means operatively coupling said first pulse generator means to said comparison means for passing a train of said first signal pulses to said comparison means during the time interval between the generation of said first and second control signals, and second gate means operatively coupling said first pulse generator means to said comparison means for passing a train of said first signal pulses to said comparison means following the generation of said second control signal;

said length measuring means include:

second pulse generator means for generating a second predetermined number of second signal pulses equal to said first predetermined number in response to the winding onto the spool of each incremental length of strand whch is substantially equal to said predetermined value, and third gate means operatively coupling said second pulse generator means to said comparison means for passing a train of said second signal pulses to said comparison means during the time interval between the generation of said first and second control signals; and said comparison means include: up-down counter means operatively connected to said third gate means for counting in one direction the number of pulses in each train of said second signal pulses passed by the gating of said third gate means and operatively connected to said second gate means for counting in the opposite direction the number of pulses in each train of said first signal pulses passed by the respective consequent gating of said second gate means, and up counter means operatively connected to said first gate means for counting the number of pulses in each train of said first signal pulses passed by the gating of said first gate means, and comparator means operating to compare the count content of said up-down counter means with the count in said up counter means following the generation of each said second control signal and to produce said direction reversing signal when the count content of said up-down counter means coincides with the count in said up counter means.

15. In a spooling machine for winding an advancing strand upon a spool having an out-turned truncated conical end flange at each end of a cylindrical barrel, said spooling machine including:

a strand guide for guiding the strand in its approach to the spool;

motive means for effecting relative rotation between the spool and the strand guide about the longitudinal axis of the spool to wind turns of the strand onto the spool;

and drive means including reversing means for effecting relative longitudinal reciprocatory movement between the spool and the strand guide along a course parallel to the longitudinal axis of the spool at a relative linear speed which is related to the speed of a relative rotational movement between the spool and the strand guide by a predetermined speed ratio to effect the uniform distribution of turns of strand along the spool and the formation of superimposed layers of said turns following the initial winding of strand onto the spool;

the improvement comprising:

rotation sensing means responsive to the relative rotation of the spool with respect to the strand guide during each relative longitudinal movement of the strand guide toward each end flange and providing a count representative of the number of turns of strand wound onto the spool commencing at the time when the strand guide passes a respective first reference position indicative of a longitudinally aligned relation of the strand guide with what would be the apex of said each end flange if the same were not truncated;

length measuring means sensing the length of strand wound onto the spool for a specified rotational movement of the spool relative to the strand guide during each relative longitudinal movement of the strand guide toward said each end flange and providing a length value representative of the length of strand wound in a predetermined number of turns onto the spool during relative longitudinal movement of the strand guide and the spool from the spool from said respective first reference position to an associated second reference position indicative of a longitudinally aligned relation of the strand guide with the respective end of the barrel at said each end flange; and means for supplying a direction reversing signal to said reversing means to reverse the direction of relative longitudinal movement between the strand guide and the spool, said reversing signal supply means including comparison means connected to said rotation sensing means and said length measuring means for comparing each said count of the number of turns with respectively provided length value and issuing said direction reversing signal when the number of turns of strand wound onto the spool attains a value which is substantially equal to the quotient of the length of strand represented by the respective length value divided by a predetermined reference value which represents the length of a single turn of strand wound onto the spool barrel during the initial winding of strand onto the spool.

16. The improvement of claim 15 including:

position detecting means responsive to the relative position of the strand guide with respect to the spool in relative approach of the strand guide to each said end flange for generating a first reference position control signal upon relative movement of the strand guide to the respective one of said first reference positions, and for generating a second reference position control signal upon continued relative movement of the strand guide to the respective one of said second reference positions;

said rotation sensing means receiving each of said first control signals as an input and providing said count by producing as an output a turns signal representative of the number of turns of strand wound onto the spool following the generation of each said first control signal;

said length measuring means receiving each of said first control signals and the respective consequent one of said second control signals as inputs and providing said length value by producing as an output a length signal representative of the length of strand wound onto the spool during the time interval between the generation of a first control signal and a consequent second control signal; and said comparison means receiving each of said turns signals and the respective concurrently produced one of said length signals as inputs and comparing each said turns signal with a respective concurrently produced length signal.

17. The improvement of claim 16 wherein:

said rotation sensing means include:

first pulse generator means for generating a first predetermined number of first signal pulses in response to each revolution of relative rotation between the spool and the strand guide, and first gate means operatively coupling said first pulse generator means to said comparison means for passing said first signal pulses to said comparison means following the generation of each said first control signal;

said length measuring means include:

second pulse generator means for generating a second predetermined number of second signal pulses equal to said first predetermined number in response to the winding onto the spool of each incremental length of strand which is substantially equal to said predetermined value, and second gate means operatively coupling said second pulse generator means to said comparison means for passing said second signal pulses to said comparison means during the time interval between the generation of each said first control signal and the consequent second control signal; and said comparison means include:

up-down counter means having input terminal means operatively connected to receive said first signal pulses when passed by said first gate means for counting in one direction and to receive said second signal pulses when passed by said second gate means for counting in the opposite direction, and circuit means operatively coupled to said up-down counter means for issuing said direction reversing signal when said up-down counter means has counted backward in said one direction to zero.

18. The improvement of claim 16 wherein:

said rotation sensing means include:

first pulse generator means for generating a first predetermined number of first signal pulses in response to each revolution of relative rotation between the spool and the strand guide, first gate means operatively coupling said first pulse generator means to said comparison means for passing a train of said first signal pulses to said comparison means during the time interval between the generation of each said first control signal and the consequent second control signal; and second gate means operatively coupling said first pulse generator means to said comparison means for passing a train of said first signal pulses to said comparison means following the generation of said second control signal;

said length measuring means include:

second pulse generator means for generating a second predetermined number of second signal pulses equal to said first predetermined number in response to the winding onto the spool of each incremental length of strand which is substantially equal to said predetermined value, and third gate means operatively coupling said second pulse generator means to said comparison means for passing a train of said second signal pulses to said comparison means during the time interval between the generation of each said first control signal and the consequent second control signal; and said comparison means include:

up-down counter means operatively connected to said third gate means for counting in one direction the number of pulses in each train of said second signal pulses passed by the gating of said third gate means and operatively connected to said second gate means for counting in the opposite direction the number of pulses in each train of said first signal pulses passed by the respective consequent gating of said second gate means, up counter means operatively connected to said first gate means for counting the number of pulses in each train of said first signal pulses passed by the gating of said first gate means, and comparator means operating to compare the count content of said up-down counter means with the count in said up counter means following the generation of each said second control signal and to produce said direction reversing signal when the count content of said up-down counter means coincides with the count in said up counter means.

* * * * *